US007188755B2

(12) United States Patent
Wu

(10) Patent No.: US 7,188,755 B2
(45) Date of Patent: Mar. 13, 2007

(54) COMBINATION METHOD OF A MODULARIZED CLAMP STRUCTURE

(76) Inventor: Raymond Wu, 12640 Belinda Ct., Lynwood, CA (US) 90262

( * ) Notice: Subject to any disclaimer, the term of this patent is extended or adjusted under 35 U.S.C. 154(b) by 139 days.

(21) Appl. No.: 11/061,658

(22) Filed: Feb. 22, 2005

(65) Prior Publication Data

US 2006/0186148 A1 Aug. 24, 2006

(51) Int. Cl.
*A41D 27/22* (2006.01)

(52) U.S. Cl. ..... 223/91; 223/93; 223/96

(58) Field of Classification Search ..... 223/85–98
See application file for complete search history.

(56) References Cited

U.S. PATENT DOCUMENTS 685,974 A * 11/1901 Cote ..... 24/507
5,183,191 A * 2/1993 Garrison et al. ..... 223/96
5,890,634 A * 4/1999 Zuckerman et al. ..... 223/96
6,306,329 B1 * 10/2001 Willinger ..... 264/255
2004/0065702 A1 * 4/2004 Yang ..... 223/96
2005/0184109 A1 * 8/2005 Goldman ..... 223/95
2006/0163294 A1 * 7/2006 Sutton et al. ..... 223/85

* cited by examiner

*Primary Examiner*—Shaun R. Hurley
(74) *Attorney, Agent, or Firm*—Troxell Law Office, PLLC

(57) ABSTRACT

A combination method of a modularized clamp structure, wherein mainly, two clamping portions of two clamps on the two ends of a suit hanger are provided thereon with two engaging channels, each engaging channel has therein a first positioning portion; two slide blocks are pushed into the engaging channels, the slide blocks each has a second positioning portion to be engaged with a corresponding one of the first positioning portions, so that the slide blocks are fixed in the engaging channels. Thereby, a user can change the two slide blocks in a flexible way, when in production, the slide blocks can be assembled and released in an energy saving mode. The clamp structure is applicable to a suit hanger for hanging paints or towels etc.

4 Claims, 4 Drawing Sheets

COMBINATION METHOD OF A MODULARIZED CLAMP STRUCTURE

BACKGROUND OF THE INVENTION

1. Field of the Invention

The present invention relates to a combination method of a modularized clamp structure, and more particularly to a method in which a slide block is pushed into an engaging channel on a clamping portion of each clamp on one of two ends of a suit hanger, so that a first positioning portion provided on the engaging channel engages with a second positioning portion provided on the slide block to fixedly engage the slide block in the engaging channel. The method is applicable to the suit hangers for hanging paints or towels etc.

2. Description of the Prior Art

A suit hanger sold in the markets mainly includes the functions of: 1. the two ends of the hanger are used to support the inner sides of the shoulder portions of a suit of clothes to keep smooth and straight of the clothes; 2. the two ends of the hanger are respectively provided with clamps for clamping pants or towels; and 3. the above two functions are combined to make the hanger a dual suit hanger. Wherein the clamps provided on the hanger generally are provided each with a front and a rear clamping portion for clamping. One of the ends for clamping on each of the front and the rear clamping portions is provided with a clamping piece being completely fixed, with the friction force of the clamping pieces, the pants paints or towels will not drop.

By the design of making the abovementioned clamping pieces completely fixed, the clamping pieces are shaped when they are produced without any flexibility for allowing changing. To get rid of the above stated defect, a U.S. Pat. No. 6,609,604 as shown in FIG. 4 which provides users with more selections mainly has a clamping portion "a" and a clamping portion "b" separated from each other; the clamping portion "b" is provided on its rear end with an engaging portion "c", and is provided thereon with a hole "d" in order that when the engaging portion "c" is extended therethrough, the clamping portion "b" and the clamping portion "a" are mutually connected. Although the above stated structure can achieve an expected objective, one end of the engaging portion "c" is larger than the hole "d"; thereby when in connecting, the engaging portion "c" can only be extended through the hole "d" for connecting when a larger pushing force is exerted. And in mass production, much time and energy will be exhausted; when in changing the clamping portion "b", a large pulling force in a contrary direction must be exerted to retract the engaging portion "c"; operation of the production is not easy, and a further problem that the engaging portion "c" is broken may occur.

In view of the above defects, and for achieving an objective of flexibility in changing a clamping piece as well as providing a structure for assembling in an energy saving mode, the inventor of the present invention provides the present invention based on his professional experience of years in nonstop studying, and developing.

SUMMARY OF THE INVENTION

The primary objective of the present invention is to provide a combination method of a modularized clamp structure, in which a slide block is pushed into an engaging channel on a clamping portion of each clamp on one of two ends of a suit hanger, and by having an engaging structure formed from the engaging channel and the slide block, the slide block can be positioned in the engaging channel; so that the two slide blocks of the two ends can be changed in a flexible way, and can be used for hanging pants or towels etc.

The secondary objective of the present invention is to provide a combination method of a modularized clamp structure, in which by having the structure of the slide blocks able to be pushed horizontally, each slide block and its corresponding clamping portion of the suit hanger can be assembled with and released from each other in an energy saving mode, thereby manpower can be much saved.

To achieve the above stated objectives, the combination method of a modularized clamp structure of the present invention comprises the following steps: a the clamping portions of the clamps on the two ends of the suit hanger are provided thereon with engaging channels, each engaging channel has therein a first positioning portion; and b. the slide blocks are pushed into the engaging channels, the slide blocks each has a second positioning portion to be engaged with a corresponding one of the first positioning portions, so that the slide blocks are fixed in the engaging channels.

The present invention has two modularized clamp structures provided respectively on the clamping portions of the clamps on the two ends of the suit hanger; each clamp structure comprises an engaging channel and a slide block. The engaging channel is provided in one side of a clamping portion, and has therein a first positioning portion; the slide blocks each has an engaging portion and a second positioning portion. When a user pushes the slide blocks, the engaging portions can be extended into two engaging channels respectively, by mutual engaging of the first positioning portions with the second positioning portions for positioning, each slide block and its corresponding clamping portion can be assembled with and released from each other in an energy saving mode.

The present invention will be apparent after reading the detailed description of the preferred embodiment thereof in reference to the accompanying drawings.

DETAILED DESCRIPTION OF THE PREFERRED EMBODIMENT

Figure 1:
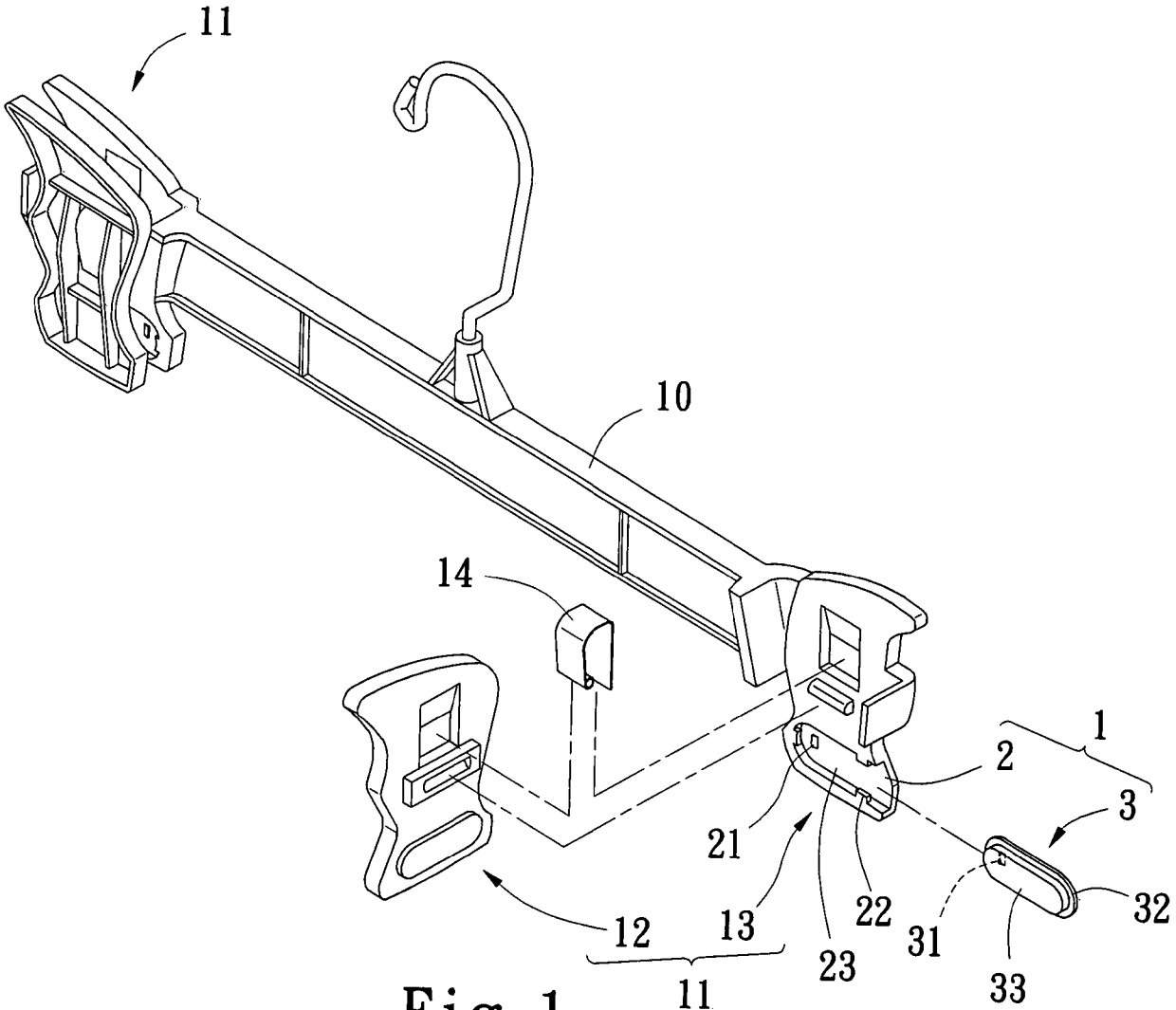
FIG. 1 is an exploded perspective view showing the elements of a preferred embodiment of the present invention.
Figure 2:
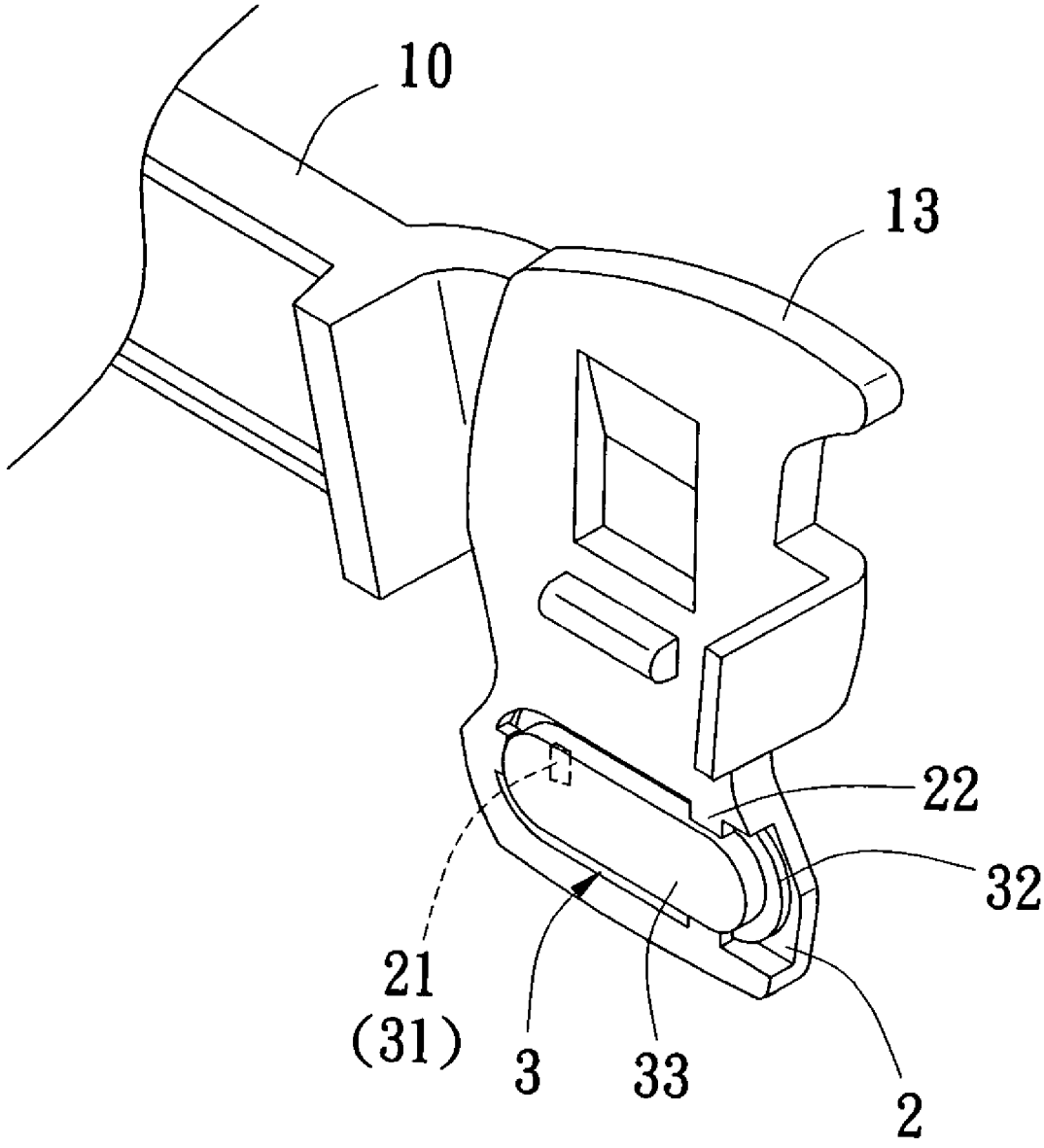
FIG. 2 is a perspective view of the preferred embodiment of the present invention.
Figure 3:
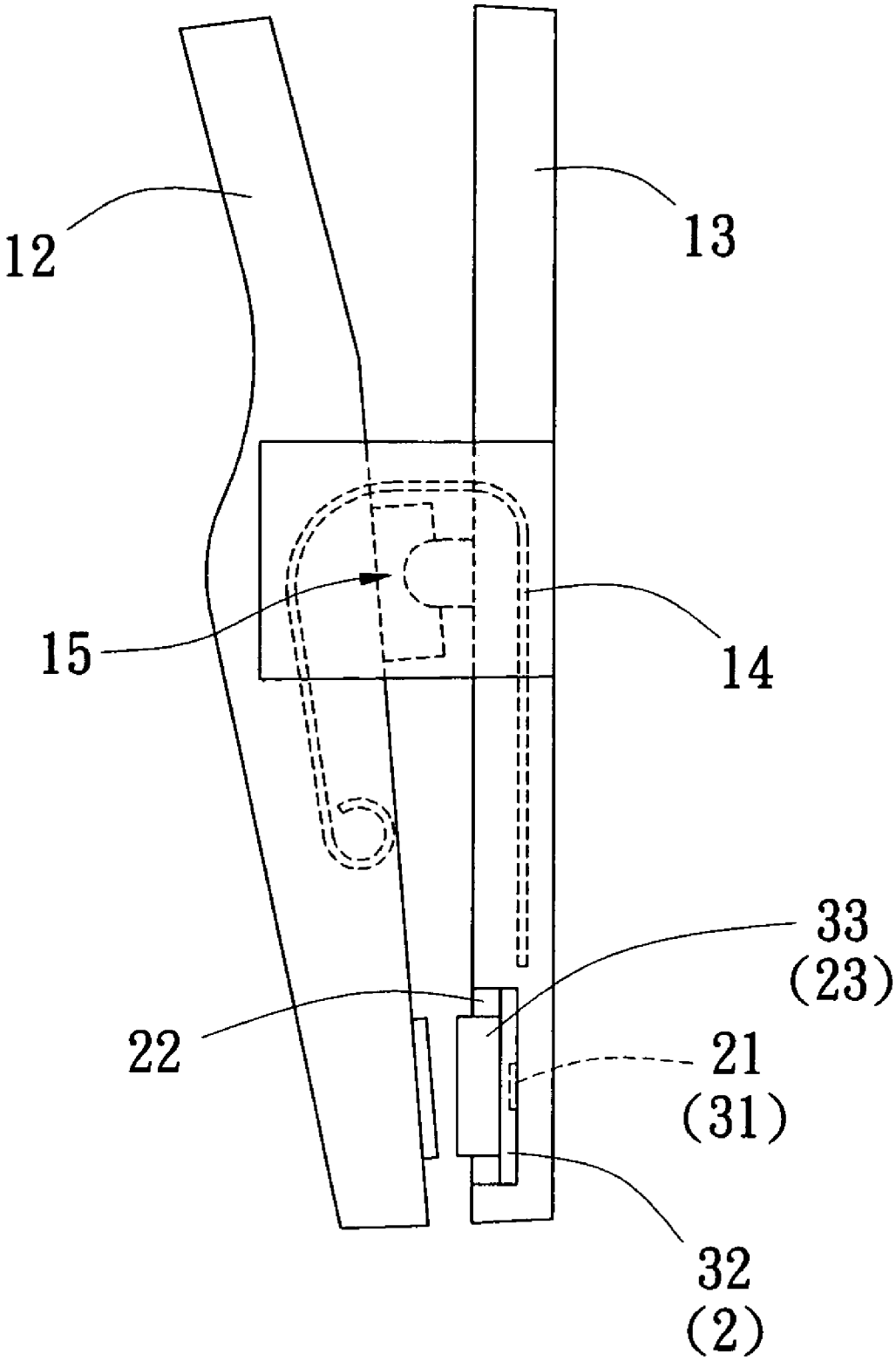
FIG. 3 is a schematic side view showing of the preferred embodiment of the present invention on a suit hanger.
Figure 4:
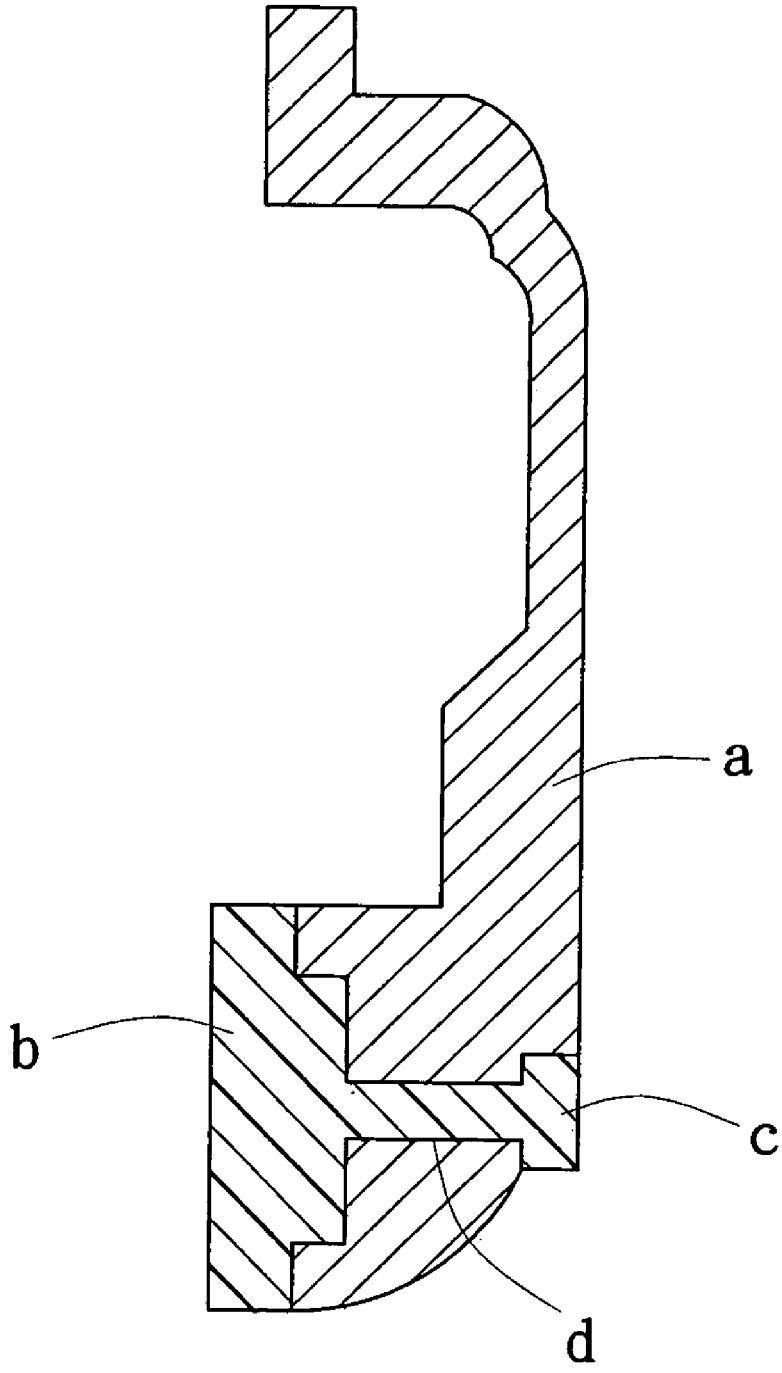
Fig. 4 (Prior Art)
FIG. 4 is a sectional view showing a conventional clamp structure after assembling.

Referring to FIGS. 1–3, the combination method of a modularized clamp structure 1 of the present invention is used on a suit hanger 10, two ends of the suit hanger 10 each has a clamp 11 including a front clamping portion 12 and a rear clamping portion 13, the two clamping portions 12, 13 are linked up with each other by a U shaped elastic piece 14 and a fulcrum means 15, when a user simultaneously press/release an end of the combination including the clamping portions 12, 13 and rotates the clamping portions 12, 13, the other end of the combination including the clamping portions 12, 13 clamps or release clothes. The combination method of a modularized clamp structure of the present invention comprises the following steps:

a. the rear clamping portions 13 (or alternatively, the front clamping portions 12) of the clamps 11 on the two ends of the suit hanger 10 are provided thereon with engaging channels 2, each engaging channel 2 has therein a first positioning portion 21;

b. slide blocks 3 are pushed into the engaging channels 2, second positioning portions 31 provided on the slide blocks 3 are engaged with corresponding ones of the first positioning portions 21, so that the slide blocks 3 are fixed in the engaging channels 2.

Referring simultaneously to FIGS. 1–3, each modularized clamp structure 1 of the present invention comprises an engaging channel 2 and a slide block 3.

The engaging channel 2 is provided in one side of a rear clamping portion 13 (or alternatively, a front clamping portion 12), one end of the side is opened; the engaging channel 2 is provided thereon with three coplanar engaging protrusions 22, an open groove 23 is formed beneath the three engaging protrusions 22; further, the engaging channel 2 is provided therein with a wedge shaped (or arched) protrusion as a first positioning portion 21.

The slide block 3 has an engaging portion 32 and an elastic portion 33, the engaging portion 32 protrudes laterally from the elastic portion 33; the engaging portion 32 and the elastic portion 33 can be two different components or can be formed integrally with each other. The slide block 3 has on its bottom a recessed wedge shaped (or arched) dent as a second positioning portion 31.

When the user pushes the slide block 3 horizontally into the opened end of the engaging channel 2, the three engaging protrusions 22 on the engaging channel 2 press the engaging portion 32 of the slide block 3, and render the elastic portion 33 of the slide block 3 to protrude upwards from the open groove 23 of the engaging channel 2 to form slide rails that can make mutual restraining of the engaging channel 2 with the slide block 3. By guiding of the slide rails, the slide block 3 can be completely pushed into the engaging channel 2 to make engagement of the first positioning portion 21 with the second positioning portion 31. If the user exerts a pushing force in a contrary direction, the first and the second positioning portion 21, 31 will be released from each other, and the slide block 3 can be retracted from the engaging channel 2.

Accordingly, the present invention has the following advantages:

1. When in production, the present invention can allow a user to change by himself the slide blocks for other slide blocks of various types in pursuance of different usages, it has quite large flexibility.
2. The present invention can have the slide blocks pushed into/out of the engaging channels with a forward/reverse pushing force, so that the user can easily change the slide blocks.

In conclusion, according to the description disclosed above, the present invention surely can achieve the expected objectives thereof to provide a modularized clamp structure allowing changing slide blocks in an energy saving mode; the present invention thus has high industrial value.

Having thus described the technical process of my invention, what I claim as new and desire to be secured by Letters Patent of the United States is:

1. A combination method of a modularized clamp structure comprising the following steps:

a. two clamping portions of two clamps on two ends of a suit hanger are provided thereon respectively with two engaging channels, each of said engaging channels has therein a first positioning portion; and b. two slide blocks are pushed into said engaging channels, said slide blocks each has a second positioning portion to be engaged with a corresponding one of said first positioning portions, so that said slide blocks are fixed in said engaging channels wherein each of said engaging channels has one end thereof opened; an open groove is formed on an upper side of said engaging channel, and wherein each of said slide blocks has an elastic portion connected to the upper side of said engaging portion, and protudes upwards from said open groove formed on said upperside of said engaging channel when said slide block is pushed horizontally into said opened end of said engaging channel.

2. A modularized clamp structure as claimed in claim 1, wherein said elastic portion and said engaging portion of said slide block are formed integrally with each other.

3. A modularized clamp structure provided on each of two clamping portions of two clamps on two ends of a suit hanger comprising:

an engaging channel provided in one side of one of said two clamping portions, and has therein a first positioning portion; and a slide block having an engaging portion in order that said slide block is pushed into said engaging channel, and having a second positioning portion for engaging said first positioning portion to make positioning of said slide block in said engaging channel wherein said engaging channel has one end thereof opened; an open groove is formed on an upper side of said engaging channel, and wherein said slide block has an elastic portion connected to the upper side of said engaging portion, and protrudes upwards from said open groove formed on said upperside of said engaging channel when said slide block is pushed horizontally into said opened end of said engaging channel.

4. A modularized clamp structure as claimed in claim 3, wherein said elastic portion and said engaging portion of said slide block are formed integrally with each other.

* * * * *